US008834326B1

(12) United States Patent
Fulks

(10) Patent No.: US 8,834,326 B1
(45) Date of Patent: Sep. 16, 2014

(54) APPARATUS FOR BI-DIRECTIONAL TORSO EXERCISE MOVEMENTS

(76) Inventor: Kent Fulks, Dallas, TX (US)

( * ) Notice: Subject to any disclaimer, the term of this patent is extended or adjusted under 35 U.S.C. 154(b) by 626 days.

(21) Appl. No.: 13/066,182

(22) Filed: Apr. 9, 2011

(51) Int. Cl.
*A63B 21/015* (2006.01)
*A63B 69/38* (2006.01)

(52) U.S. Cl.
USPC ..... 482/92; 482/140; 482/142

(58) Field of Classification Search
USPC ..... 482/92–106, 141–142
See application file for complete search history.

(56) References Cited

U.S. PATENT DOCUMENTS 6,015,370 A * 1/2000 Pandozy ..... 482/97
7,507,191 B2 * 3/2009 Zachary ..... 482/142
2006/0166799 A1 * 7/2006 Boland et al. ..... 482/140
2006/0211549 A1 * 9/2006 Nohejl ..... 482/97
2007/0129225 A1 * 6/2007 Hammer ..... 482/129
2007/0259760 A1 * 11/2007 Perez ..... 482/140

* cited by examiner

*Primary Examiner* — Stephen Crow
(74) *Attorney, Agent, or Firm* — John F. Bryan

(57) ABSTRACT

Apparatus for bi-directional torso exercise movements has a main-frame base with a seat and upwardly extending columns at either side to support a "U" shaped first sub-frame, mounted so that it pivots about a horizontal first axis passing above the seat, and a second sub-frame mounted to the first sub-frame cross bar for pivotal movement about a second axis generally perpendicular to the horizontal first axis and thereby, mounted for pivotal movement about both axes. A motion transfer linkage is provided to force simultaneous pivotal movement of both sub-frames when either is moved, so as to involve compound muscle groups in an exercise movement.

17 Claims, 5 Drawing Sheets

APPARATUS FOR BI-DIRECTIONAL TORSO EXERCISE MOVEMENTS

TECHNICAL FIELD

This invention relates generally to exercise machines, and more particularly, to exercise machines for muscles of the torso wherein the user's movements are opposed by a selected resistance.

BACKGROUND OF THE INVENTION

Many athletes and non-athletes utilize weight lifting or weight training exercises to build muscle strength, to prevent injury, or to improve overall condition and appearance. Typically, weight training exercises are performed with either exercise machines or free weights, such as barbells with weighted plates or dumbbells.

Free weights offer certain advantages over exercise machines. For instance, they are relatively inexpensive in comparison to exercise machines. Free weights are also generally more versatile because a variety of exercises can be performed in different planes with the same set of weights, whereas exercise machines are usually designed for movements limited to a specific plane. However, the human body is by no means limited to two dimensional, planar movements. Thus, in an effort to replicate the benefits of multi-dimensional exercise activities, comprehensive exercise programs will incorporate both machines and free weights. In so doing, a variety of exercise routines are combined to work specific muscles and muscle groups in more than two dimensions for a more natural result.

Complex muscle groups act for torso movements, such as any combination of bending the chest and shoulders forward or back and twisting the torso toward either side. To varying degrees these movements twisting the torso toward either side. To varying degrees these movements involve the oblique, abdominal and erector muscles, according to the range and direction of the movement. Since these muscles must act in diverse directions, they exemplify muscle groups which cannot be fully exercised and developed by exercises confined to a single plane as in torso machines taught in prior art. While there may be floor exercises for these muscle combinations, providing useful weight resistance for such movements is awkward at best. Prior art torso exercise machines do not provide for fully bidirectional exercise of the torso muscles, therefore, the object of the present invention is to provide a method and apparatus for bi-directional torso exercises, where movements are not confined to a single plane.

SUMMARY OF THE INVENTION

The present invention addresses the aforesaid object with improved exercise methods and apparatus. Herein, according to this invention, are disclosed exercise devices affording bi-directional resistance movements of the torso for exercise of the oblique, erector and abdominal muscle groups. The invention relates to or employs some details well known in the arts and therefore, not the subject of detailed discussion herein.

A preferred embodiment of the present invention utilizes weights to provide an incrementally adjustable resistance to the exercise movement. The apparatus has a conventional main frame and a centrally mounted user seat. A vertical plane of symmetry extending through the middle of the mainframe and seat would show the two sides to be essentially mirror images. An adjustable height user's seat, backed by low profile lumbar support, is centrally mounted to the mainframe on a seat support member. A separately mounted member, a "U" shaped, first sub-frame passes below the user's seat and is mounted for pivotal movement about a horizontal first axis. This first axis is transversely mounted to pass directly above the seat, at approximately the elevation of the abdomen of a seated user.

An "L" shaped second sub-frame, with the long leg of the "L" extending upward, behind the user's seat, is mounted to the bottom of the "U", for left or right hand pivotal movement about a central axis. This more or less vertical axis extends upwardly through the user's seat, in front of the lumbar support and proximate the spine of a user. A pad, mounted to the pivoting second sub-frame above the level of the lumbar support, is located to contact the upper back of a user. A handle assembly is hingedly attached at the top of the second sub-frame and has a pair of frontal support pads positioned to contact a user's chest at shoulder level. Right and left hand lever arms extend forwardly from this handle assembly. Thus, as the user pulls down on these lever arms during an exercise movement the lever arm support pads come to bear against the user's shoulders.

The transverse first pivotal axis passes horizontally through the top ends of the "U" of the first sub-frame and intersects or near intersects the vertically inclined second axis. It is notable that, the vertically inclined axis and horizontal axis are mutually perpendicular and that the pivoting movement of the first sub-frame is interconnected by a linkage with that of the second sub-frame. Adjustable resistance is provided for exercise movements by incremental addition of weights to an arm extending from the first sub-frame. The weight arm may be positioned to extend to the rear, where the weight provides resistance for forward torso bending exercises, or alternatively to the front, where it provides resistance for back extension exercises.

The lever arms provide exercise force input points to effect pivotal exercise movement of the first and second sub-frames about their respective axes in an interrelated manner, so as to rotate the torso sideways, exercising the oblique muscles, while bringing the shoulders forward, thereby exercising the abdominal muscles. The user can elect to twist his torso to either the left or the right while bending and the first/second sub-frame linkage interconnection provides for selection of either exercise mode.

The method of the present inventions is enabled by another pivoting member, an "L" shaped sub-frame mounted to pivot about a vertically inclined axis proximate the spinal column of a user and intersecting the transverse horizontal axis, proximate the abdomen of the user. Mounting these members for pivotal movement about both axes; and opposing such movement with a selected resistance, are the essential elements of the present invention. Implementation of the invention involves the user grasping hand grips and bearing against them to turn and pull the sub-frame into a right or left hand exercise movement by pivoting it about both axes simultaneously. In each of the embodiments, the resistance opposing such exercise movements is provided by an appropriate weight placed on an arm extending more or less horizontally in a forward or rearward direction from the "U" shaped sub-frame. Rearward placement works the abdominal muscles while forward placement works the extensors.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
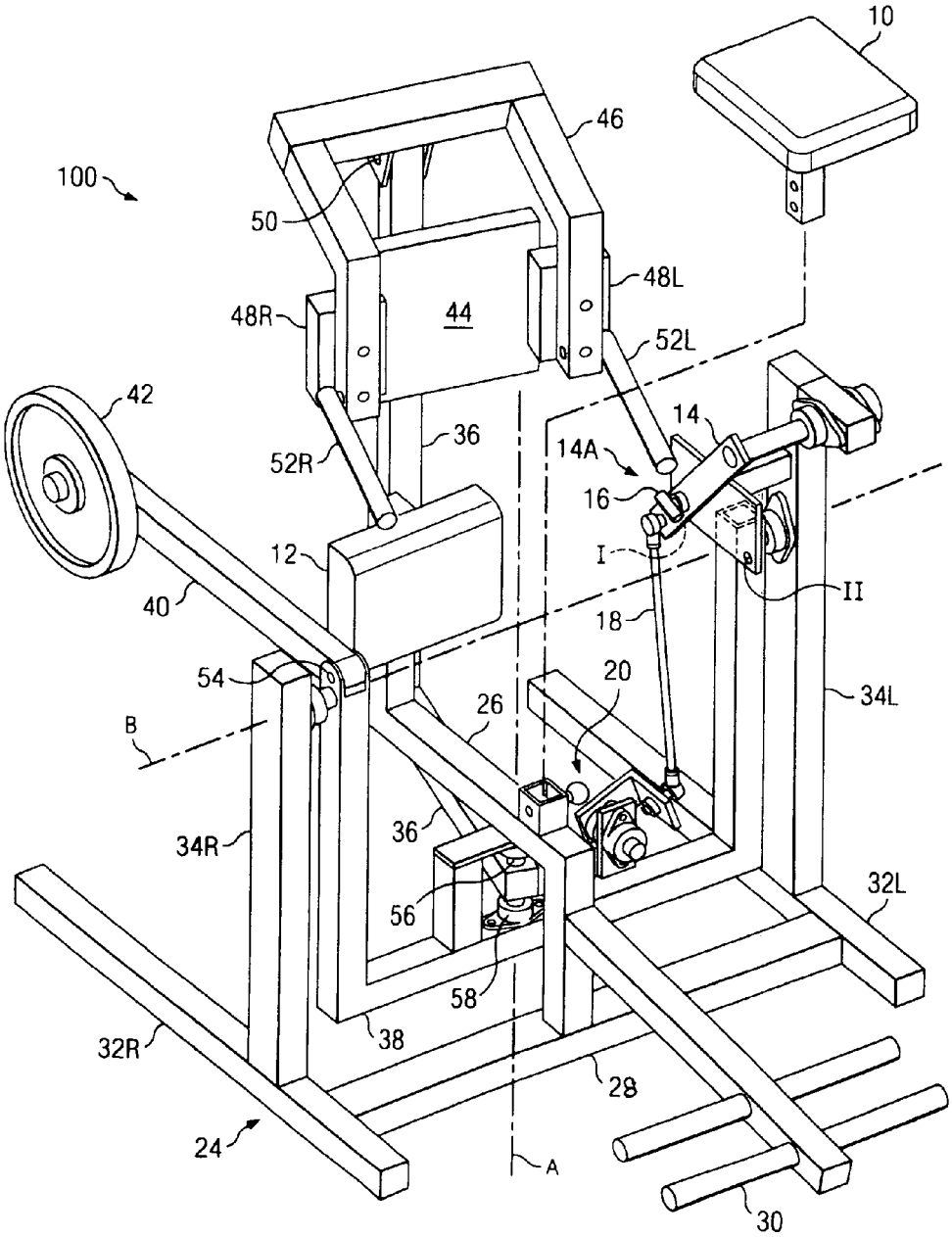
FIG. 1 is a front view of a preferred embodiment of a bi-directional torso exercise machine according to the present inventions, shown as in the first exercise mode, during which the torso will rotate counter-clockwise when bending forward or clockwise when extending rearward.

The present invention is described with reference to drawings of a preferred example of how the invention can be made and used. In these drawings, reference characters are used throughout the views to indicate same or corresponding parts. The embodiment described herein is exemplary, Many details are well known in the arts, and as such may be neither shown nor described.

FIGS. 1-6 illustrate a preferred embodiment 100 of a bi-directional exercise machine for the torso employing the methods of the present inventions. In FIG. 1, embodiment 100 is shown as it appears when exercise mode master link 14 of motion transfer linkage 14A is set, with selection pin 16 in location "I", for the first exercise mode, during which the torso will rotate counter-clockwise when bending forward, or clockwise when extending rearward. Seat 10 is mounted at an adjustable height on support member 26 of main-frame 24 and lumbar support 12 is mounted in a fixed, universal position.

Mainframe 24 is formed of standard rectangular steel tubing, with transverse base member 28 and longitudinal base members 32R and 32L providing an "H" shaped "footprint". Column members 34R and 34L extend vertically from longitudinal base members 32R and 32L and foot rest members 30 extend to the front. Column members 34R and 34L support transversely disposed, "U" shaped sub-frame 38 for pivotal movement about horizontal axis "B". Weight arm 40 extends more or less horizontally, swinging on hinge connection 54 to either the front or the rear to hold weight 42. Weight 42 may comprise individual plates, added incrementally to provide a user selected resistance for exercise movements.

The horizontal cross bar of "U" shaped sub-frame 38 passes below seat 10 to pivot parallelly about horizontal axis "B" located above seat 10. "L" shaped sub-frame 36 is centrally mounted on the cross bar by bearings 56 and 58 below seat 10 for pivotal movement about vertically inclined axis "A". Notably, horizontal axis "B" and vertically inclined axis "A" will intersect at a point proximate a seated user's abdomen, the relative elevation being set by adjusting the height of seat 10. An imaginary vertical mid-plane extending through the middle of mainframe 24 would essentially be a plane of symmetry. The right and left sides of device 100, with the exception of the motion transfer linkage 14A, comprising the master link 14, spring loaded selection pin 16, linkage member 18, bell crank assembly 20 and linkage member 22, would thus seen as mirror images with respect to a vertical mid-plane.

Upper back support pad 44 is fixedly mounted, at approximately user shoulder height, to "L" shaped sub-frame 36, so as to bear against the back of a user. Hinged input assembly 46, with shoulder support members 48L and 48R providing areas to bear against the front of the user's shoulders, swings about attaching hinge 50 at the upper end of sub-frame 36. Right and left lever arms 52L and 52R extend forward from shoulder support members 48L and 48R on either side of hinged input assembly 46, so that they can be gripped for exercise input force application.

Figure 5:
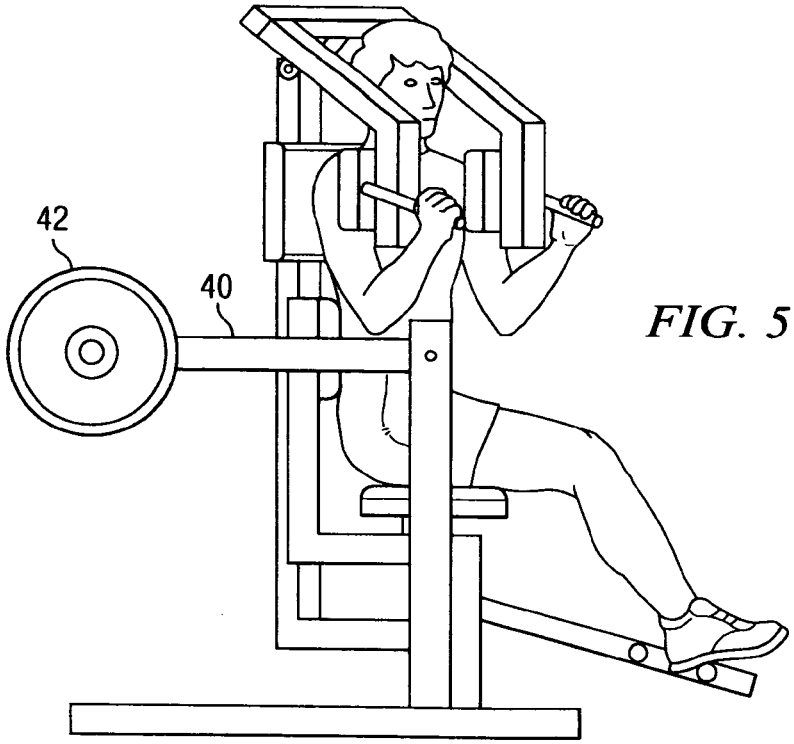
FIG. 5 is a side view, showing the embodiment of FIG. 4, with a user ready to begin a forward bending exercise in the first mode.

Vertical first axis "A" extends upwardly through the user seat 10, in a more or less vertical direction, in front of lumbar support 12, so as to be proximate the spine of a user. Hinged Input assembly 46 is attached at the top of pivoting sub-frame 36 and is raised, to allow access for seating a user, then lowered to bring shoulder support pads 48R & 48L into frontal contact with the user's shoulders. Upper back support pad 44 is mounted to pivoting "L" shaped sub-frame 36 above the level of lumbar support 12, and located to oppose right and left shoulder pads 48R and 48L. When performing an abdominal exercise, with weight arm 40 in the rearward position, a user grips lever arms 52R and 52L and pulls down, causing support pads 48R & 48L to bear frontally against the shoulders as shown in FIG. 5. As the movement continues, in the manner of a "crunching" exercise, the motion transfer linkage of motion transfer linkage 14A causes rotation of the user's torso to either the right or left, according to the selected First or Second Mode.

Figure 2:
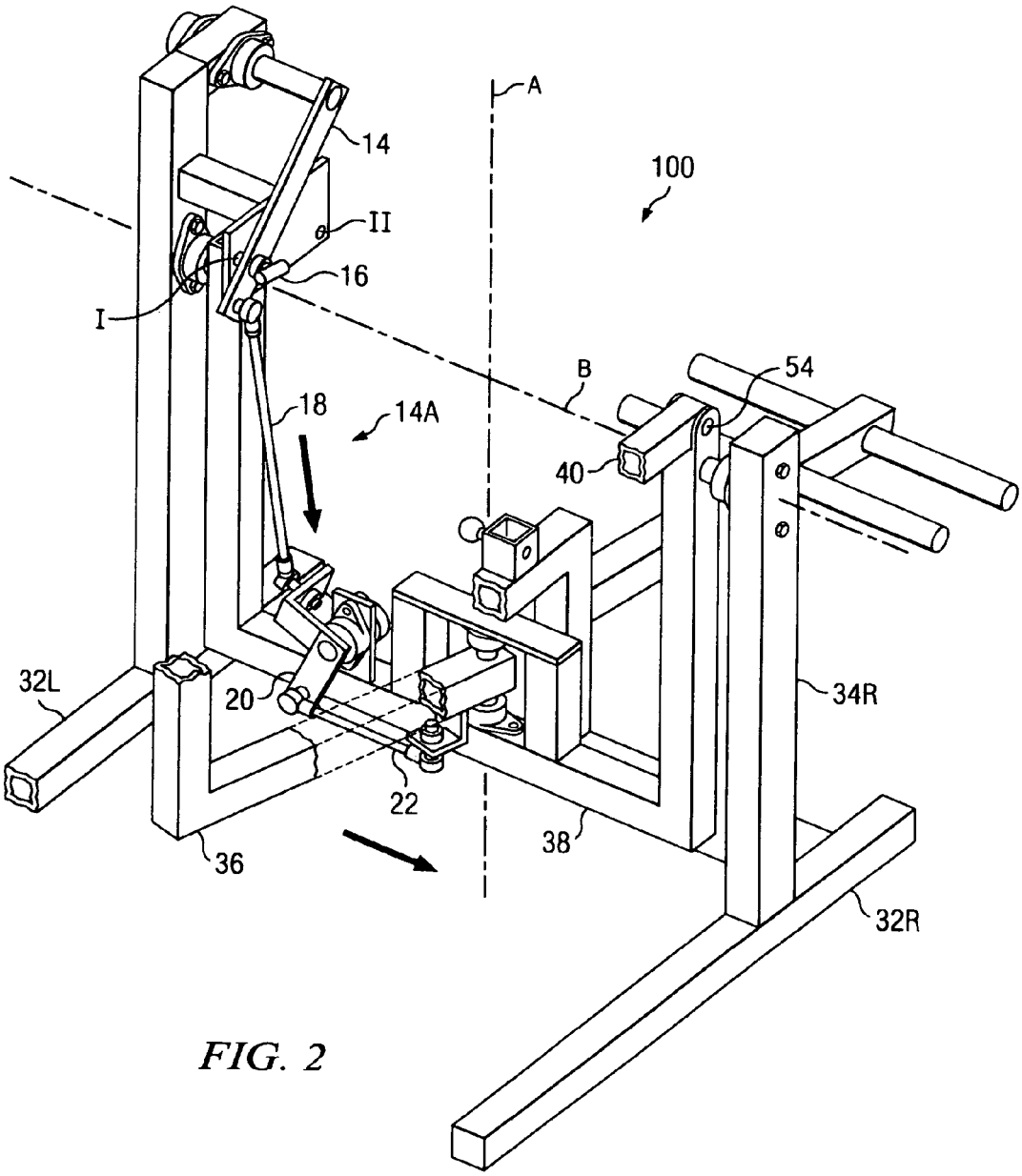
FIG. 2 is a three-quarter rear view of the embodiment of FIG. 1, shown as in the first exercise mode.
Figure 3:
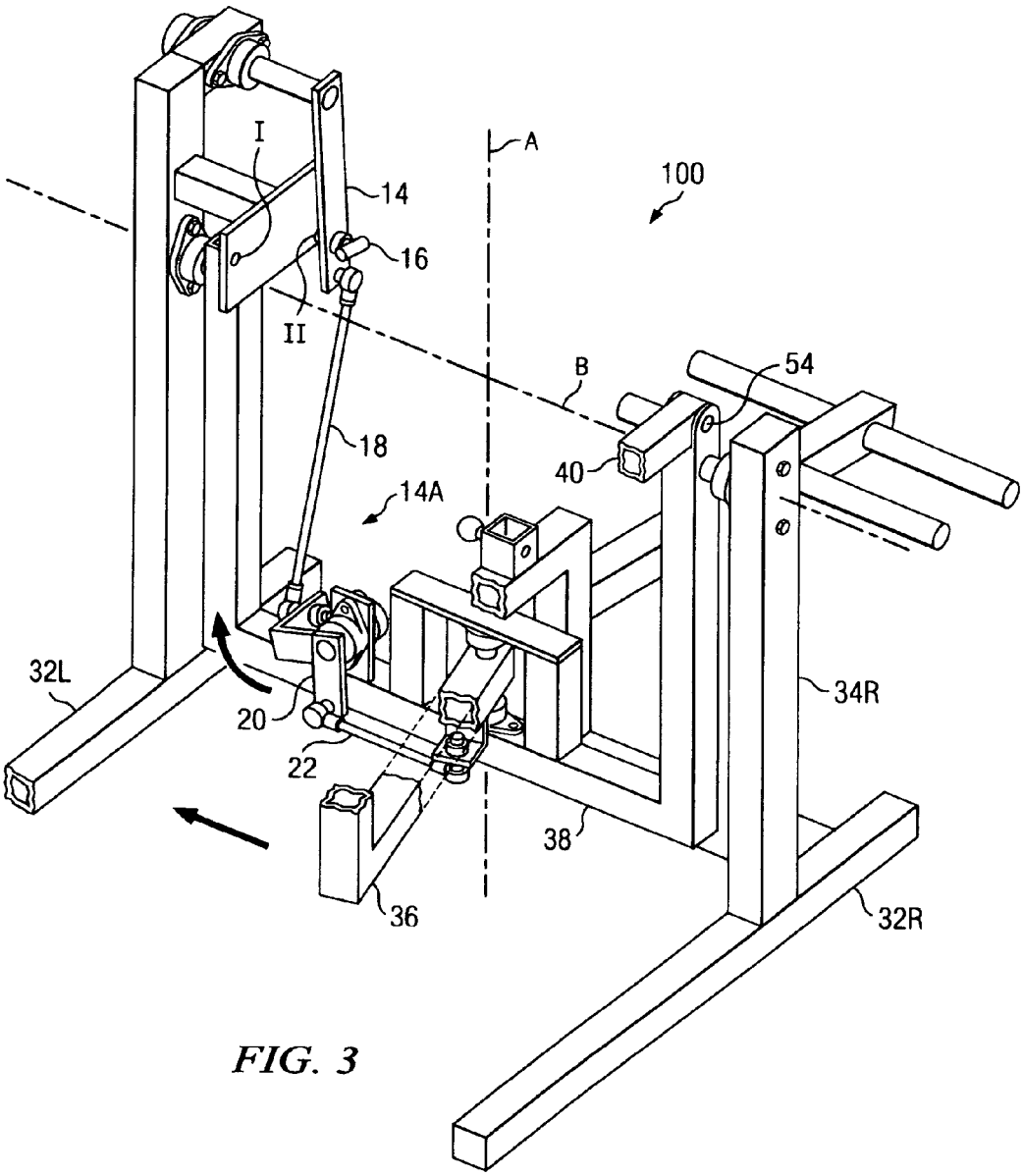
FIG. 3 is a three-quarter rear view of the embodiment of FIG. 1, shown as it appears when set for the second exercise mode.

FIG. 2, shows embodiment 100 at the clockwise end of the pivotal movement range of "L" shaped sub-frame 36. With master link 14 connected by selection pin 16 at location "I", motion transfer linkage 14A is set for a "First Mode" exercise. Here, as sub-frame 38 swings to the rear about axis B, linkage member 18 pushes on bell-crank assembly 20, making it pivot counter-clockwise. In turn, link 22 pushes against sub-frame 36, making it pivot simultaneously to the right (counter-clockwise as viewed from above). Similarly, as shown in FIG. 3, where sub-frame 36 is shown in the fully counter-clockwise position, connecting master link 14 for a "Second Mode" exercise by inserting selection pin at location "II" reverses pivotal movements of sub-frame 36 relative to sub-frame 38. In this case, as sub-frame 38 swings to the rear, linkage member 18 pulls on bell-crank assembly 20, making it pivot clockwise. In turn, link 22 pulls on sub-frame 36, so that it pivots to the left (clockwise as viewed from above). In either case, increments of weight (42) added to weight arm 40 will selectively increase resistance to the exercise movement.

Figure 4:
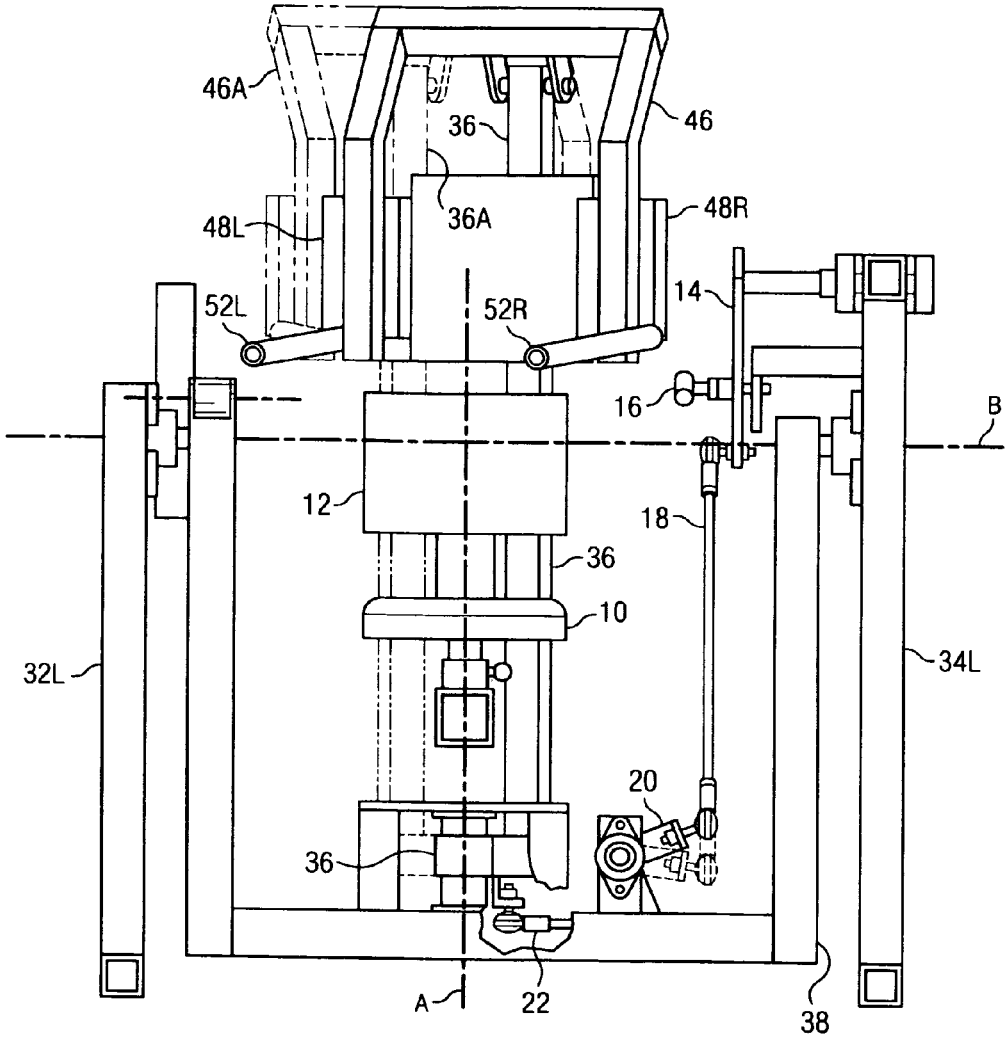
FIG. 4 is a front view, showing the embodiment of FIG. 1 as positioned to begin a first mode, forward bending abdominal exercise.

FIG. 4 is a front view, showing embodiment 100 configured to begin a "First Mode", forward bending abdominal exercise. Here, sub-frame 36 is shown pivoted to a fully clockwise starting position. Shifting mode selection pin 16 to location "II", for "Second Mode" exercise movements, pivots sub-frame 36 to the fully counter-clockwise starting position 36A, as shown by phantom lines.

FIG. 5 is a side view, showing the embodiment of FIG. 4, with a user as he would appear when ready to begin a forward bending exercise in the "First Mode". Note that at the beginning of the exercise movement, the user's torso is rotated clockwise to the right. As the abdominal muscles contract, sub-frame 38 swings rearward and the exercise movement progresses, with sub-frame 36 pivoting (counter-clockwise as viewed from above). This brings the left oblique muscles into action, demonstrating the bi-directional characteristic of machines embodying the present inventions. Similarly, movements performed in the Second Mode would exercise the abdominal and right oblique muscle groups.

Figure 6:
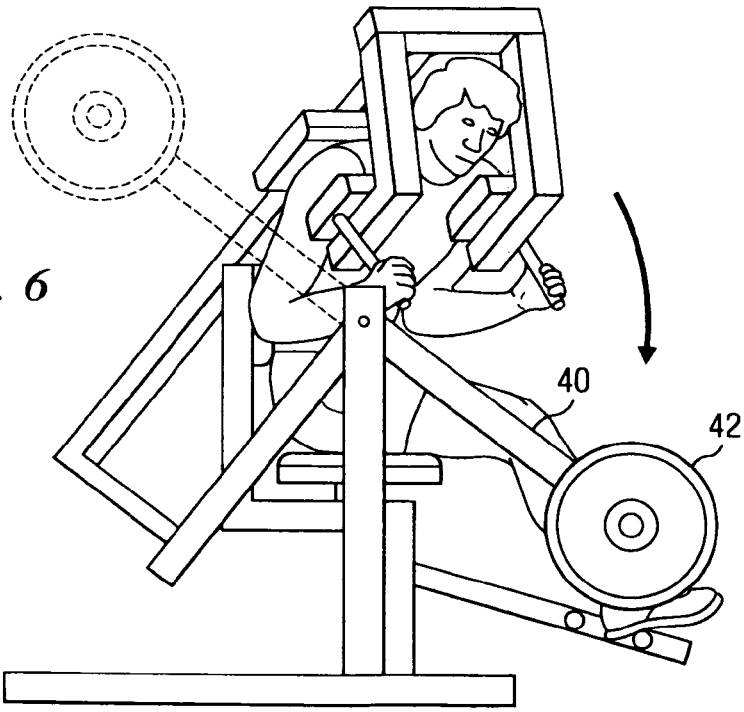
FIG. 6 is a side view, showing the preferred embodiment, with the weight arm extending forward and the user ready to begin a back extension exercise in the second mode, during which the torso will rotate counter-clockwise.

FIG. 6 shows the configuration for embodiment 100 of the present inventions for performing a back extension exercise. Here, weight arm 40 is shown swung to the forward position as indicated by the arrow, reversing the direction of resistance, and the user is shown ready to begin this second mode exercise, during which the torso will rotate counter-clockwise. As the user grips lever arms 52R and 52L, pulls up and forces the shoulders toward an upright position, shoulder support pads 48R & 48L bear frontally against the user's shoulders. In this manner, the left side quadratus lumborum, extensor spinae, ilicostalis lumborum and oblique muscle groups are active in the exercise movement. Similarly, shifting to the First Mode will exercise the opposite, right side muscle groups It is to be understood that the methods of the above-described invention, used as described to create bi-directional torso exercise movements may be applied in other exercise machine embodiments, so that the present invention is not limited to the disclosed embodiment. The principle of the invention may be applied in an alternative embodiment for torso exercise machines combining a pushing or pulling movement with a rotional movement to provide for compound exercise of designated muscle groups. Although a preferred embodiment has been illustrated in the accompanying drawings and described in the foregoing Detailed Description, it will be understood that the inventions are not limited to the embodiment disclosed but, include other expressions within the scope of the following claims.

I claim:

1. Apparatus for bi-directional torso exercise movements, comprising:

a mainframe including a base and vertically extending columns at either side thereof;

a seat mounted on the mainframe for supporting and positioning a user;

a "U" shaped first sub-frame, disposed in a plane transverse to the mainframe and mounted to the mainframe, with a horizontal cross-bar located below the seat, so that the cross bar pivots parallelly about a horizontal first axis passing above the seat and proximate the abdomen of a seated user;

a second sub-frame mounted to the first sub-frame cross bar for pivotal movement about a second axis, perpendicular to and intersecting the horizontal first axis, and having lever arms, for application of an input effort causing pivotal movement of the second sub-frame about the first axis; and a motion transfer linkage whereby pivotal movement of the second sub-frame about the first axis simultaneously forces its pivotal movement about the second axis.

2. The apparatus of claim 1 and further comprising:

an incrementally adjustable weight opposing such pivotal movement of the "U" shaped sub-frame, so that a selected exercise force must be exerted therefor.

3. The apparatus of claim 1 wherein the motion transfer linkage may be selectively connected to reverse pivotal movement about the second axis with respect to that about the first axis.

4. The apparatus of claim 1 and further comprising an adjustment mechanism for varying the seat height.

5. The apparatus of claim 1 and further comprising:

a foot support member extending forwardly from the main frame.

6. The apparatus of claim 1 and further comprising:

an incrementally adjustable weight opposing such pivotal movement of the lever arm about both axes, so that an exercise force must be exerted therefor.

7. Apparatus for bi-directional torso exercise movements, comprising:

a mainframe including a generally symmetrical base, with upwardly extending columns at the mainframe sides and a horizontal first axis established at the column upper ends;

an adjustable height seat and lumbar support mounted centrally on the mainframe, for supporting a user;

a "U" shaped first sub-frame, with essentially vertical sides, mounted for pivotal movement about a horizontal first axis, with that the "U" shape bottom member passing under the seat, and the first axis approximately at the abdomen of the user;

an "L" shaped second sub-frame having the distal end of the lower "L" member centrally mounted on the "U" cross member for pivotal movement about a second axis, effectively perpendicular to and intersecting the first axis and proximate the lumbar support;

the upwardly extending "L" member having an input lever assembly hingedly affixed at the upper end thereof, and a back support pad mounted above the lumbar support;

the input lever assembly including right and left pads located to bear frontally at a user's shoulders, with right and left lever arms extending forwardly to be gripped by a user; and a motion transfer linkage whereby pivotal movement of the "L" shaped sub-frame about either first or second axis simultaneously forces pivotal movement about the other axis.

8. The apparatus of claim 7 and further comprising:

an incrementally adjustable weight opposing such pivotal movement of the "L" shaped sub-frame, so that a selected exercise force must be exerted therefor.

9. The apparatus of claim 7 wherein the motion transfer linkage may be selectively connected to reverse pivotal movement about the second axis with respect to that about the first axis.

10. The apparatus of claim 7 and further comprising:

a foot support member extending forwardly from the main frame.

11. The apparatus of claim 7 and further comprising:

an incrementally adjustable weight opposing such pivotal movement of the lever arm about both axes, so that an exercise force must be exerted therefor.

12. Apparatus for bidirectional torso exercise movements comprising:

a mainframe comprising a first horizontal axis and a second, essentially vertical axis;

a member mounted on the main frame and adapted for pivotal movement about the axes against a selected resistance;

a motion transfer linkage, guiding the member for simultaneous pivotal movement about the first axis in a first direction and the second axis in either a second or third direction, the linkage including a master link selectively connecting the member for simultaneous movement in either the first and second directions or the first and third directions, whereby a user is required to rotate the torso sideways about the second, vertical axis one way in a second direction or the opposite way in a third direction, while bending the upper body forward about the first, horizontal axis in a crunching motion.

13. The apparatus of claim 12 and further comprising:

an incrementally adjustable weight opposes such pivotal movement, so that a selected exercise force must be exerted therefor.

14. The apparatus of claim 12 wherein the motion transfer linkage may be selectively connected to reverse pivotal movement about the second axis with respect to that about the first axis.

15. The apparatus of claim 12 and further comprising an adjustable height user seat mounted on the main frame.

16. The apparatus of claim 12 and further comprising:

a foot support member extending forwardly from the main frame.

17. The apparatus of claim 14 and further comprising:

an incrementally adjustable weight opposing such pivotal movement of the lever arm about both axes, so that an exercise force must be exerted therefor.

* * * * *